US010321211B2

(12) United States Patent
Curtinsmith et al.

(10) Patent No.: US 10,321,211 B2
(45) Date of Patent: Jun. 11, 2019

(54) METHOD AND APPARATUS FOR PROVIDING CUSTOMISED SOUND DISTRIBUTIONS

(71) Applicants: David Curtinsmith, Cronulla (AU); Paul Anthony Childs, Cronulla (AU); Erin Curtinsmith, Cronulla (AU)

(72) Inventors: David Curtinsmith, Cronulla (AU); Paul Anthony Childs, Cronulla (AU); Erin Curtinsmith, Cronulla (AU)

( * ) Notice: Subject to any disclaimer, the term of this patent is extended or adjusted under 35 U.S.C. 154(b) by 0 days.

(21) Appl. No.: 15/518,165

(22) PCT Filed: Oct. 9, 2015

(86) PCT No.: PCT/AU2015/000604
§ 371 (c)(1),
(2) Date: Apr. 10, 2017

(87) PCT Pub. No.: WO2016/054679
PCT Pub. Date: Apr. 14, 2016

(65) Prior Publication Data

US 2017/0295418 A1 Oct. 12, 2017

(30) Foreign Application Priority Data

Oct. 10, 2014 (AU) ..... 2014904043
Apr. 7, 2015 (AU) ..... 2015901241

(51) Int. Cl.
*H04R 1/02* (2006.01)
*H04R 1/20* (2006.01)
*H04R 5/02* (2006.01)
*H04R 1/40* (2006.01)
*H04S 5/00* (2006.01)

(52) U.S. Cl.
CPC ..... *H04R 1/023* (2013.01); *H04R 1/20* (2013.01); *H04R 1/403* (2013.01); *H04R 5/02* (2013.01); *H04R 2201/401* (2013.01); *H04R 2203/12* (2013.01); *H04S 5/00* (2013.01)

(58) Field of Classification Search
CPC . H04R 1/023; H04R 1/20; H04R 5/02; H04R 1/403; H04R 2201/401; H04R 2203/12; H04S 5/00
See application file for complete search history.

(56) References Cited

U.S. PATENT DOCUMENTS 3,648,801 A * 3/1972 Huszty ..... H04R 1/323 181/147
7,260,235 B1 * 8/2007 Henricksen ..... H04R 1/403 181/199
7,813,516 B1 * 10/2010 Graber ..... H04R 3/12 381/182

(Continued)

*Primary Examiner* — Sonia L Gay

(57) ABSTRACT

A speaker system is disclosed for providing customised acoustical wavefronts with vertical and horizontal pattern control and amplitude and phase control. The system including a speaker housing (1) having therein at least a first array (2) of high frequency driver segments (3) and at least a secondary array (4) of low frequency driver segments (5) disposed behind said first array (2), said first array having sufficient space between said driver segments (3) to allow acoustic transparency whereby a wavefront from said secondary array (4) can substantially pass through said first array (2).

20 Claims, 3 Drawing Sheets

(56) References Cited

U.S. PATENT DOCUMENTS

| | | | | |
|---|---|---|---|---|
| 7,991,175 | B2 * | 8/2011 | Nielsen | H04R 1/323 381/332 |
| 8,967,323 | B1 * | 3/2015 | Grenier | H04R 1/403 181/198 |
| 2007/0011196 | A1 * | 1/2007 | Ball | H04H 60/45 |
| 2007/0110269 | A1 * | 5/2007 | Levitsky | H04R 1/26 381/335 |
| 2009/0116652 | A1 | 5/2009 | Kirkeby | |
| 2010/0002889 | A1 * | 1/2010 | Jorgensen | G06F 17/5004 381/59 |
| 2010/0061571 | A1 * | 3/2010 | Choi | H04R 1/288 381/160 |
| 2010/0226499 | A1 * | 9/2010 | De Bruijn | H04R 1/403 381/17 |
| 2010/0316242 | A1 * | 12/2010 | Cohen | H02K 41/03 381/337 |
| 2013/0010984 | A1 * | 1/2013 | Hejnicki | H04R 27/00 381/107 |
| 2013/0101134 | A1 | 4/2013 | Betts-Lacroix | |
| 2014/0079264 | A1 * | 3/2014 | Minarik | H04R 1/023 381/332 |
| 2015/0223002 | A1 * | 8/2015 | Mehta | H04S 7/30 381/303 |
| 2015/0289050 | A1 * | 10/2015 | Butler | G10K 11/22 381/387 |

* cited by examiner

METHOD AND APPARATUS FOR PROVIDING CUSTOMISED SOUND DISTRIBUTIONS

CROSS-REFERENCE TO RELATED APPLICATIONS

This application is a continuation and national stage application of International Application, PCT/AU2015/000604, filed Oct. 9, 2015, which claims the benefit of Australian Patent Application No. 2014904043 filed on Oct. 10, 2014, and Australian Patent Application No. 2015901241 filed on Apr. 7, 2015, the entire contents of all of which are hereby incorporated by reference.

FIELD OF THE INVENTION

The present invention relates broadly to sound systems, more specifically although not exclusively, it discloses an apparatus for providing customised spatial distribution of sound and a method for controlling the spatial distribution of such an apparatus to address a variety of listening situations

BACKGROUND OF THE INVENTION

In order to maximise sound quality it is currently known to provide 2-way (having separate high frequency and low frequency drivers) and higher-way loudspeakers having only static (or mechanical) control of sound, or having dynamic control of a single dimension of sound dispersion characteristics (usually noted as the vertical dimension, however speaker rotation can alter this single dimension to be relative to the horizontal dimension). The second dimension (usually noted as the horizontal dimension) dispersion angles however are currently limited to the mechanical (static or fixed) inbuilt characteristics of a 2-way loudspeaker. Furthermore, conventional prior art 2-way loudspeakers only feature high frequency drivers either alongside or overlaying the low frequency drivers, in a singular line. These mechanical limitations only allows for conventional 2-way speaker to scale and adapt in a single dimension only.

In some cases band-limited drivers in a 2-dimensional arrangement may be utilised as a 1-way speaker, however this technique is not supportive of high fidelity full bandwidth audio due to the compromise of driver size and driver performance. Therefore, existing prior art audio systems are unable to provide a controlled dynamically adaptive 2 dimensional wavefront across both vertical and horizontal planes across the full audio bandwidth, including both high and low frequencies.

In the case of differential control of signals sent to individual speakers of a multiple driver system conventional prior art techniques may include:

(i) Change of the sound direction by applying a linearly varying delay across a speaker array, (ii) Focusing or de-focusing of the sound by applying a quadratically varying delay across a speaker array, and (iii) Heuristically achieving a near-enough sound distribution by manual variation of the parameters of the individual speakers.

In the far-field limit, the wave equation reduces to a Fourier transform. In this case the change of direction can be seen to be achieved by the Fourier Shift Property $$f(x)e^{\frac{2\pi}{\lambda}iax} \rightarrow \mathscr{F}\left(s-\frac{a}{\lambda}\right) \tag{1}$$

Where: $\lambda$ is the wavelength of the sound $s=\sin(\theta)/\lambda$ ($\theta$ is the angular subtenance from the normal to the speakers)

a is the linear delay (given as sin of the deflection angle)

F is the Fourier Transform of f:

$$\mathscr{F}(s)=\int_{-\infty}^{+\infty}f(x)e^{-2\pi ixs}dx. \tag{2}$$

The (de)focusing is achieved by applying a phase equivalent to that of a Fresnel lens with focal length b:

$$e^{\frac{2\pi}{\lambda}i\frac{x^2}{2b}} \tag{3}$$

These three methods (i, ii, and iii); however, are insufficient for the purposes of most environments where a natural asymmetry exists (e.g. an auditorium or sports stadium). Therefore other techniques are needed. The Fourier transform can be used, but this is often inadequate, due to the delay at the audience being ambiguous. This means that there is not one unique solution, but many; and the problem extends to the more difficult problem of determining which is the optimal solution (solutions will typically specify an attenuation of individual speakers—thus losing the efficiency of utilizing all the available energy and in addition the frequency dependence, due to the $\lambda$ term in s, needs to be considered).

SUMMARY OF THE INVENTION

In accordance with one aspect of the invention a speaker system is disclosed for providing customised acoustical wavefronts with vertical and horizontal pattern control and amplitude and phase control, said system including a speaker housing having therein at least a first array of high frequency driver segments (high frequency speakers) and at least a secondary array of low frequency driver segments (low frequency speakers) disposed behind said first array, said first array having sufficient space between said driver segments to allow acoustic transparency whereby a wavefront from said secondary array can pass through said first array.

In accordance with another aspect of this invention, a method is also disclosed of extending on the aforementioned methods (i and ii) of changing the direction and focus to further include a method for changing the asymmetry of the sound distribution. This also uses the delay applied to the speakers of the array.

More specifically a method is disclosed which comprises initial steps of providing a linear and quadratic delay in accordance with eqs. (1) and (3) in order to change the direction of the beam or its spread. Then a delay in accordance with eqn. (4) is applied to change the asymmetry.

$$Ai(s) \xleftarrow{\mathscr{F}} c^{-\frac{i}{3}(2\pi x)^3} \tag{4}$$

Eqn. (4) makes use of the property of the Airy function, whose Fourier transform is a cubic phase term. The effect of adding a cubic delay will thus act to cause a convolution with the Airy function in the far field: inducing a skew in the distribution of the sound accordingly. The uniqueness of the Airy function and Dirac distribution in being algebraic transforms of phase functions makes modeling their behavior much more straightforward.

In accordance with a further aspect of the invention, a method is also disclosed of calculating an additional delay to be applied to speakers of an array, wherein (excepting linear, quadratic and cubic terms) components of the delay are determined as a Fourier series in order to flatten ripples in the spatial variation of the sound distribution and/or improve consistency of the frequency dependence of the sound distribution.

The combined phase term for the example of one cosine term is given as:

$$e^{\frac{2\pi}{\lambda}i\Delta\cos\left(\frac{2\pi}{\Lambda}x\right)} \tag{5}$$

where $\Delta$ is the amplitude of the particular periodic function and $\Lambda$ is its period. In this, the delay can be taken as the negative of the term within the brackets.

The Fourier transform of eq. (5) is given as:

$$\sum_{n=-x}^{+x} J_n\left(\frac{2\pi}{\lambda}\Delta\right)i_n\delta\left(s-\frac{n}{\Lambda}\right) \tag{6}$$

where $\delta$ is the dirac delta function, which equals one when the argument is zero, and zero otherwise. This can be seen to create additional harmonics of the spatial distribution shifted by angles of:

$$\theta_n = \sin^{-1}\left(n\frac{\lambda}{\Lambda}\right) \tag{7}$$

The Fourier series are calculated on the basis of an analysis of the spatial distribution of the acoustic wave by selecting $\Lambda$ so that the $\theta_n$ match half the period of any oscillations in the spatial distribution. $\Delta$ is selected so as to minimise these oscillations This analysis can be carried out by means of any Harmonic analysis (e.g. Fourier transform, short-time FFT, wavelet) and/or optimisation technique to reduce the higher frequency peaks in the power spectrum (e.g. least mean squares regression, simulated annealing).

It accordance with yet a further aspect of the invention an audio speaker is disclosed for use with the above method which includes a sound radiating surface with vertical and horizontal dimensions, said dimensions being defined by discreet segments, each segment being associated with a respective single acoustic source which is provided a processed and amplified signal to create an amplitude and phase controlled horizontal and vertical sound pattern.

Preferably the segment shall be limited to ten wavelengths in size of the highest controlled frequency. Optimal performance is achieved when the segment size is reduced to less than one wavelength in size.

Preferably said signal processing comprises digital signal processing (DSP) in the form of phase, delay, amplitude, IIR filter and FIR filter processing.

It is further preferred that the method of control, DSP processing, and amplification are either internal or external to said audio speaker.

It is further preferred that the distance between the outer edges of the acoustic source radiating surface in one segment and the outer edges of the acoustic source radiating surface in an adjacent segment are limited to ten wavelengths in distance of the highest frequency the segment is controlling. Optimal performance is achieved when this distance is limited to less than one quarter the wavelength in distance of the highest frequency the segment is controlling.

It is further preferred that the range of frequencies the speaker produces are divided into one or more frequency bands through the use of band limiting filters.

When more than one frequency band is being utilised, each frequency band preferably complies with the above-mentioned guidelines, forming one set of segments across the surface of the plane array. Each band-limited segment may be layered in three dimensional space over each other. Each layer of band-limited segments may be discreetly processed.

It is further preferred that each band limited layer sitting above another band limited layer is sufficiently acoustically transparent to allow one band limited plane array wavefront to acoustically pass through any outer layer band limited layer. To achieve acoustical transparency a minimum perforation size of 10% is preferred.

BRIEF DESCRIPTION OF THE DRAWINGS

One currently preferred embodiment of a speaker box in accordance with this invention will now be described with reference to the following drawings in which.

DETAILED DESCRIPTION OF A PREFERRED EMBODIMENT OF THE INVENTION

A speaker according to the present invention will be described below in relation to a single unit. However, it will be appreciated by those skilled in the art that the speaker of the present invention may be adapted such that multiples of the speaker can be vertically and horizontally stacked to produce a larger system.

Such a larger system can be of any size and shape and can produce one or more custom acoustic wavefronts with vertical and horizontal pattern control and amplitude and phase control. While any size speaker system according to this invention can control horizontal and vertical pattern control, and amplitude and phase control down to any selected low frequency limit, optimal results occur when said larger system has a vertical length or horizontal length greater than one wavelength in length of the lowest frequency to be controlled.

A speaker according to this invention is capable of producing complex non-symmetrical acoustical wavefronts with vertical and horizontal pattern control and amplitude and phase control. As an economic alternative, a more cost affective version of this invention can be produced by powering symmetrically opposite acoustic sources from the same processing and amplification stage. Such a variation of this invention will only limit the invention to producing symmetrical custom acoustical wavefronts with vertical and horizontal pattern control and amplitude and phase control.

Figure 1:
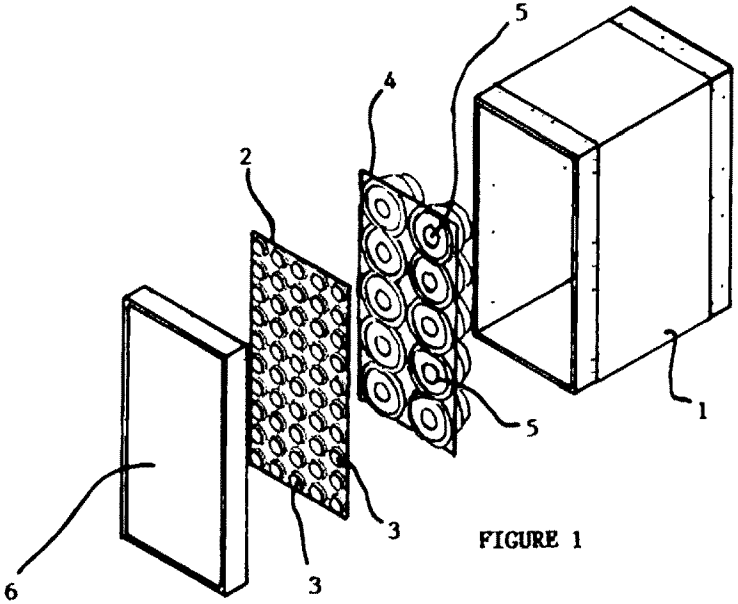
FIG. 1 is an exploded perspective view of an audio speaker according to said invention.
Figure 2:
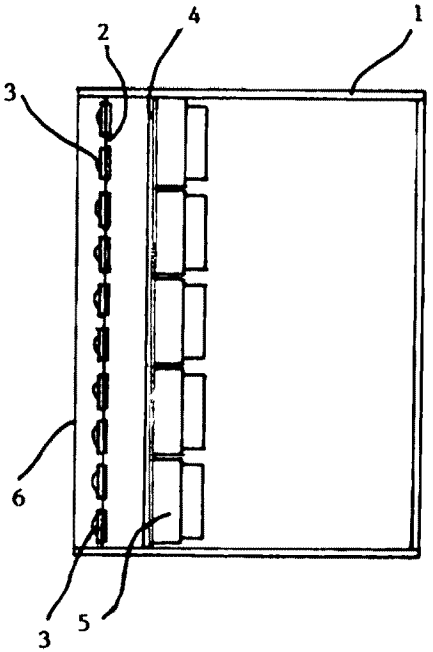
FIG. 2 is a cross sectional side elevation of the assembled speaker of FIG. 1.

Referring to FIG. 1, a two way speaker system according to an embodiment of the present invention is depicted. The speaker system may comprise an aluminium housing (1) with an stainless steel panel (2) of 22 mm diameter soft-dome tweeters (3) (high frequency segments) generating 1.5 kHz-20 kHz band limited sound. The 22 mm diameter soft-dome tweeters may be spaced at a distance of 5.3 cm pitch vertically and horizontally, creating a primary plane array of 50 tweeters in 5 columns and 10 rows. The overall speaker housing size is preferably about 26.5 cm wide and 53 cm tall, with a total of 50 high frequency segments in the array of tweeters (3). Each soft-dome tweeter point source is preferably about 40 mm in diameter including the mounting frame. Mounted below the high frequency plane is an aluminium panel (4) mounting a secondary low frequency plane array comprised of ten 4¾" drivers (5) (low frequency segments) generating 20 Hz-1.5 kHz band limited sound. Each 4¾" low frequency driver is preferably spaced at about 106 mm vertically, and about 125 mm horizontally. There are ten low frequency segments in this secondary plane array. The high frequency segments (3) have sufficient space between drivers to allow for approximately 54% acoustic transparency. There is an aluminium front casing trim (6). Each low frequency (LF) and high frequency (HF) segment is fed a unique and custom calculated processed audio signal from an audio source (not shown). Custom electronics and amplification provides unique signal processing for each LF and HF segment preferably in the form of 2 seconds of delay, four bi-quad IIR filters, one 10 co-efficient FIR filter, one low pass filter, one high pass filter, and amplitude control per output. Two inputs may be provided, each with unique processing for each input is applied and summed prior to each amplifier module. With this current embodiment there are preferably a total of 60 amplifier channels.

The above described embodiment is capable of creating a custom horizontal and vertical controlled wavefront with amplitude and phase control, with control over the operating band of 20 Hz-20 kHz. As will become more apparent below, the speaker system of the present invention is further capable of vertical and horizontal pattern control from 180 degrees down to 1 degree in both the horizontal and vertical planes, as well as more complex 2D and 3Dimensional wave fronts (with the 3 dimensions being the horizontal axis, the vertical axis, and acoustic magnitude). As will be further discussed, the speaker system is further capable of adopting a "dual monitor mode" as it features two uniquely processed sound source inputs. These modes of operation of the present speaker system are described below to provide integration into "Live Venue Setup", "Live Venue Operation", "Live Performer Tracking", "3-Dimensional Plane Array Sound Bar", and "3-Dimensional Plane Array Cinema" systems.

Live Venue Setup

In venues where audio is amplified and projected to a listener audience, audio must be transmitted to the audience in a manner sufficient to enhance the audience's listening experience. In many situations, this is difficult to achieve due to the variation between venues and the manner in which different venues are structured.

The interaction of projected sound and the environment of a venue creates 2 major issues that are unique for a venue:

1) Varying distances between listener and speaker. Changes in distances translate to variations in sound pressure levels.
2) Various surfaces reflecting sound. This is usually called room reverberation or sound reflections, and effects sound quality. The less sound radiating towards surfaces where there are no listeners, the less reverberation and the more natural sound and higher quality sound.

With "Live Venue Setup", along with the speaker system of the present invention, it is possible to set up the system to accommodate the venue where sound is being projected to optimize the listening pleasure of the audience attending the venue.

As will be described in more detail below, this is achieved through the use of conventional range-finder and/or laser distance measurement equipment that provide a simple means for electronically mapping the venue to enable computer determination of the distances to the audience (listener) plane within a 3-Dimensional space, which can be used to configure the speaker system in accordance with the present invention.

By using the preferred mathematical model, as described below, it is possible to create a custom acoustic wavefront for said speaker system to yield the best acoustic performance results for the space. This can include reducing acoustic energy directed at problematic acoustic surfaces within the space, limiting acoustic energy to be directed towards audience locations only, and optimising sound pressure levels and other acoustic qualities to create a more uniform experience across the entire listener field.

Figure 3:
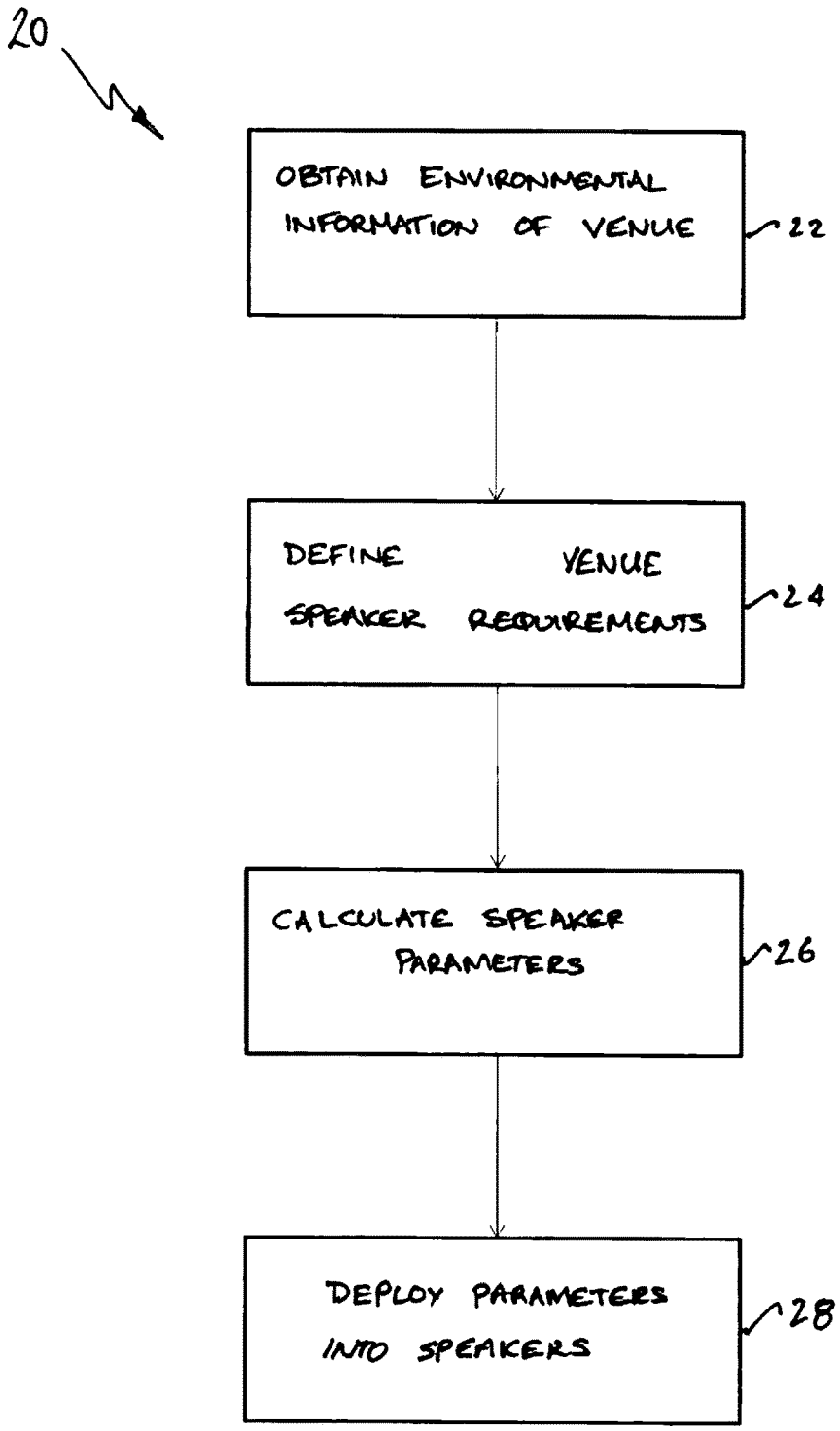
FIG. 3 is a diagram depicting a preferred set up method for a live venue system to accommodate the speakers.

A method 20 of setting up a live venue system to accommodate the speaker systems of the present invention in preparation for a performance, is depicted in FIG. 3.

The method 20 comprises a first step 22 whereby the environmental information of the venue in which sound is to be projected is obtained. This step may be performed through the use of a commercially available laser rangefinder, such as the Opti-logic RS800, which is mounted on a commercially available pan-tilt motorized mount, such as the JEC J-PT-1205. Such a laser_rangefinder typically has computer interface abilities, such as RS232, and is operable to target non-reflective surfaces of between 10 m and 30 m range, at a minimum. A small computer or microcontroller is fitted to the commercially available laser range finder on the pan-tilt motorized mount. This small computer is able to control the pan-tilt motorized mount, as well as read back the data from the laser range finder. In a preferred form, the small computer may be a Raspberry Pi miniature computer, with RS232 port and RS485 port for control of both the laser rangefinder and motorized mount.

In an embodiment of this method, a visible laser may be fitted to the overall system to allow for visual feedback showing the position of the aiming of the laser range finder. Alternatively a camera may be mounted to the viewfinder of the laser range finder, which can be streamed via a standard video link to a controller interface. In a preferred form, the camera is connected to the Raspberry Pi, or similar miniature computer, to stream the video to the operator via a standard Ethernet network link, wired or wireless.

As part of obtaining the environmental information of the venue in step 22, the laser range finder with the pan/tilt motorized control may be located anywhere within the venue. However, in a preferred situation, the laser range finder is mounted to mounting or suspension brackets that fly or mount the plane array speaker system of the present invention within the venue. In this way, the laser range finder can have the same view as the loudspeaker, making geometric calculations of the venue more simplistic.

The Raspberry Pi, or similar computer, can be remotely controlled to automatically scan the local environment of the venue, panning across the entire horizontal and tilting vertical ranges of the venue and transmitting distance measurements from the laser rangefinder at a set resolution to the small computer to generate a 3-Dimensional model of the room. From this model, an array of data is able to be constructed containing distance information for each horizontal and vertical angle of resolution. The operator can then define the targeted area of coverage for the speaker through manual input.

In a preferred form, the operator is able to control the Raspberry Pi, or similar computer, via a wireless Ethernet network. In this way the operator is able to remotely access the data from a remote operator position and firstly determine a minimum of 4 boundary locations based on the 3-D model of the venue. Nominally these 4 boundary locations are typically be the rear right hand corner of the audience location of the venue, the rear left hand corner of the audience location of the venue, the front left hand corner of the audience location of the venue and the front_right hand corner of the audience location of the venue. It will be appreciated that for venues having a more complex shape or audience location such as a circular or curved audience location, more than 4 audience boundary locations can be set.

These 4 or more audience boundary locations provide co-ordinate input information for the operator to automatically adjust the pan and tilt position of motorized mount. A resolution of 1 degree vertical and 1 degree horizontal increment size is preferred, however other resolutions are also suitable. After the motorized mount is moved to a position, the laser range finder distance is read, thereby constructing the data array of distance for each vertical and horizontal position. This process is repeated until the entire region bounded by the 4 or more boundary locations is covered in accordance to the resolution nominated. Once the array of data has been created which contains distance information relative to pan and tilt angle information that is bounded to the audience location, the operator has the necessary environmental information necessary, thereby completing step 22.

In step 24, the operator must then define the inputs to the plane array speaker system. Typically this requires the operator defining the speaker types suitable for the venue, which includes an assessment of the quantity of speakers required as well as the arrangement of the speakers and location within the venue.

In step 26, upon defining the speaker requirements, the general the speaker parameters which includes the size, shape and spacing of individual transducers within the speaker box are able to be determined. The speaker parameters are generally known through the use of a library of parameters that is provided by the speaker manufacturer. With such knowledge of the type of speakers being installed at the venue and the parameters of those speakers, the operator is able to calculate the best match of the plane array speaker system parameters to optimize the listener pleasure in the specific venue. Optimal selection of the values of a, b, the asymmetry for the Airy function, $\Delta$ and $\Lambda$ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc.

In step 28, once the optimal parameters of the plane array speaker system are determined, the optimized parameters can be directly deployed by the operator to the hardware speakers. In this manner the plane array speaker system can be optimally programmed by the operator to create a multi dimensional acoustic wavefront that best matches the audience shape and listener distances of the venue, whilst keeping as much acoustic energy away from any non-audience locations identified in the 3-D map of the venue. Such a method of setting up a speaker system for a venue results in a significant improvement to sound quality within the audience environment by removing as many reflections as possible. Furthermore, the sound within the audience location is also optimized to be as even as possible in terms of both tonal characteristics and sound pressure levels.

Live Venue Operation

Some venues may have an open space into which the audience may be received, but the audience may congregate only in a portion of that space, whilst at other venues, the audience may scatter across a space. The less sound radiating towards surfaces where there are no listeners, the less reverberation and the more natural sound and higher quality sound. Throughout the coarse of an event within a venue, the audience locations and occupancy may be fluid, constantly changing.

Figure 4:
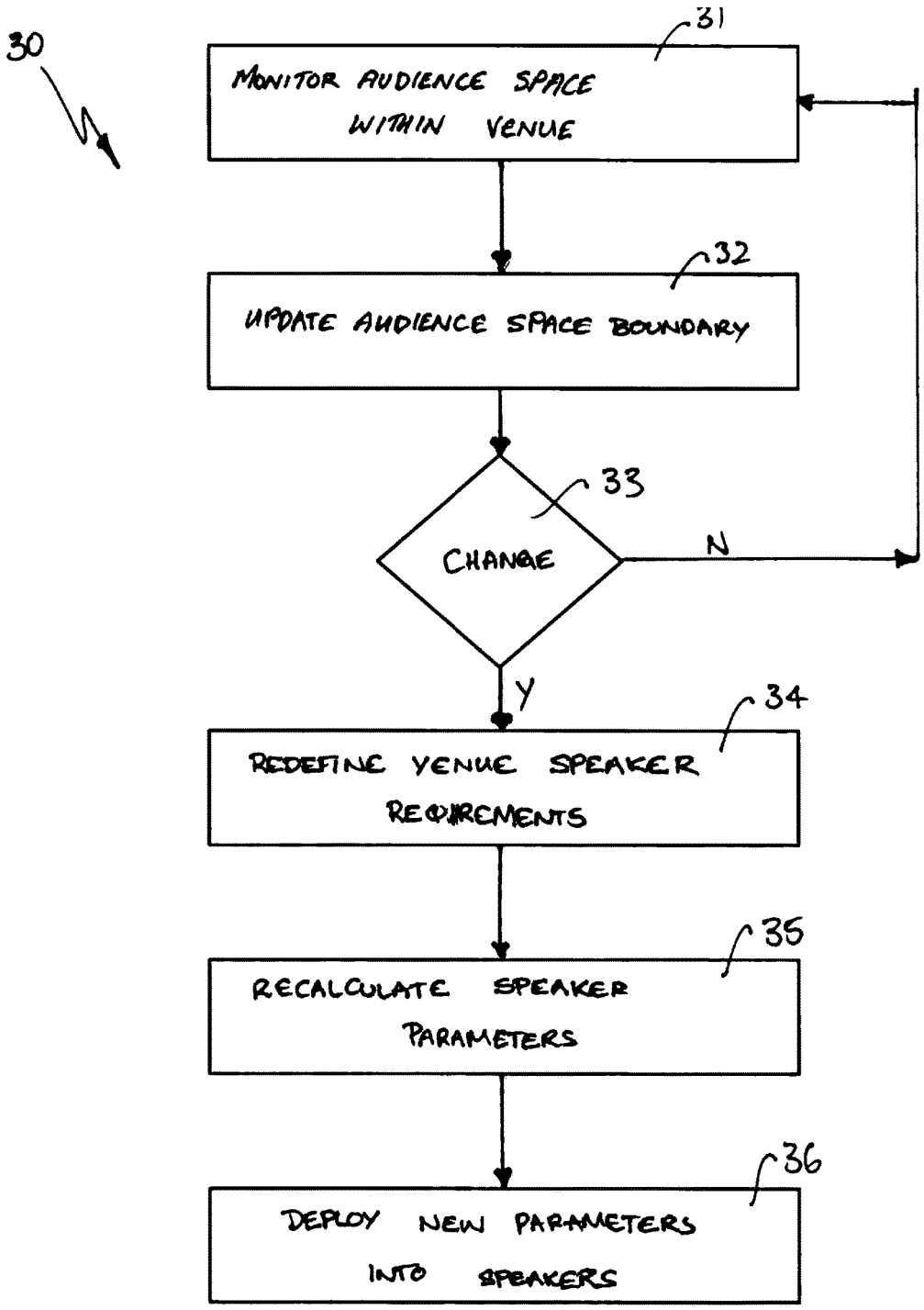
FIG. 4 is a diagram depicting a preferred for ongoing adaptation of the sound system

It will be appreciated that the set-up method 20 described above in relation to FIG. 3 provides a simple and effective means for adapting the speaker system of the present invention to the venue projecting sound. However, the system of the present invention can also provide ongoing adaptation of the sound system during an event as the venue parameters vary. The method 30 for achieving this is depicted in FIG. 4.

In step 31, the audience space of the venue is monitored during the event. This may be achieved through the use of a live camera system and facial recognition software, which is able to assess and determine listener locations within the venue. By monitoring changes in the listener locations, it is possible to update the custom acoustic wavefront for the speaker system to limit acoustic energy such that it is directed specifically at occupied spaces. Such a system improves intelligibility and other acoustic qualities by reducing the acoustic energy directed at un-occupied reflective surfaces.

As previously discussed above in relation to the method 20 for setting up the speaker system, a commercially available camera system is typically setup and configured to observe the space in which a plane array speaker is covering. This camera can be located anywhere within the venue, however preference is given for to the camera to be mounted to the mounting or suspension brackets that fly or mount the Plane array speaker system, or beside the loudspeakers. In this way, the camera can have the same view as the loudspeaker, making geometric calculations more simplistic.

The provision of third party facial recognition software that can be run on the computer system, provides ongoing analysis of occupancy of the venue with relative co-ordinates in the X-Y plan of horizontal and vertical locations relative to the loudspeaker. The preferred third party facial recognition software is a Cisco video surveillance system. In this regard, an operator is able to monitor the third party facial recognition software to read back occupancy sensing data, along with co-ordinate information. This information can then be translated to update the audience boundary conditions in step 32.

In step 32, this audience boundary conditions can be updated to the "Live Venue Setup" module as outlined above. The new boundary locations can be referenced to an array of information already captured through laser scanning or physical measurement of distances for each vertical and horizontal position within the new bounded audience location, by the resolution nominated (typically 1 degree resolution in both the horizontal and vertical).

Once the array of data is created, containing distance information relative to pan and tilt angle information that is bounded to the audience location, the operator has the necessary environmental information necessary. In step 33 an assessment is made to determine whether the audience space boundary conditions have changed and if there is no change, the system continues to monitor the audience space in step 31. However, if it is determined in step 33 that there is a change in the audience space due to an increase in audience numbers or alteration in the configuration of the audience space, and that audience space boundary has changed, the system will then seek to redefine the venue speaker requirements in step 34. In step 34, the operator must define the inputs to the plane array system, which will typically involve defining the speaker types, quantity of speakers, and arrangement of the speakers covering the nominated audience location. Other aspects of the speakers will also be determined, such as the size, shape and spacing of individual transducers within the speaker box. In most cases, such aspects of the speaker will be known through the use of a library of parameters published by the speaker manufacturer. In this step, the operator is expected to input manually the type of speakers used, the quantity of speakers, and how the speaker array is constructed.

In step 35, once all environmental and speaker inputs are known, the software can calculate the best match of the plane array speaker system parameters to match the changing environment. Optimal selection of the values of a, b, the asymmetry for the Airy function, Δ and Λ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc.

In step 36, once the optimal parameters of the plane array speaker system are determined, the optimized parameters can be directly deployed by the operator to the hardware speakers. In this manner the plane array speaker system can be optimally programmed by the operator to create a multi dimensional acoustic wavefront that best matches the continually changing audience shape and listener distances of the venue, whilst keeping as much acoustic energy away from any non-audience locations of the venue. Such a method of setting up a speaker system for a venue results in a significant improvement to sound quality within the audience environment by removing as many reflections as possible. Furthermore, the sound within the audience location is also optimized to be as even as possible in terms of both tonal characteristics and sound pressure levels.

Dual Monitor Mode

In another embodiment of the present invention, the speaker system may be controlled to provide a dual monitor mode of operation, whereby the speaker may be controlled to produce one or more acoustic wavefronts at the same time. By using more than one sound source, and applying different discrete processing for each sound source, the custom acoustic wavefronts can be summed and produced by a single speaker system in accordance with this invention. In this regard, summation of the acoustic wavefronts can occur pre or post amplification stage.

Such a duel monitor mode of operation of the speaker system of the present invention provides a specific application whereby a first stage monitor mix can be directed towards a performer on stage, whilst a second stage monitor mix can be directed towards a different performer on stage, through the single speaker system.

As such, the dual monitor mode of operation relates to a method of operating the present speaker system such that two or more multi-dimensional acoustic wavefronts are simultaneously operated, each being fed from a separate audio input.

In a first step of the method of operating the present invention in a dual mode of operation, an operator firstly determines a first desired acoustic wavefront. This is preferably achieved by an operator defining one multi-dimensional wavefront using manual inputs of the desired target dispersion. One such example of the desired target dispersion may be a 40 degree wide beam in the horizontal, panned +20 degrees in the horizontal plane, with a 40 degree wide beam in the vertical, panned +45 degrees in the vertical plane.

After establishing this first desired acoustic wavefront, the system software is able to determine the optimal selection of the values of a, b, the asymmetry for the Airy function, Δ and Λ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. In this step, the best operating parameters for each loudspeaker element is determined to create the desired acoustic wavefront shape and directionality of this acoustic wavefront. Upon establishing these parameters, for the plane array speaker, these parameters can then be deployed to the speaker via a selected communication method, preferably by way of wireless Ethernet connection.

In accordance with the dual mode of operation, once the initial acoustic wavefront has been set up with the speaker system, the operator can then define additional multi-dimensional wavefronts using manual inputs of the target dispersion. One such example of this target dispersion may be a 40 degree wide beam in the horizontal, panned −20 degrees in the horizontal plane, with a 40 degree wide beam in the vertical, panned +45 degrees in the vertical plane. For each additional wavefront, optimal selection of the values of a, b, the asymmetry for the Airy function, Δ and Λ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. The best parameters for each loadspeaker element can then be determined to create the desired acoustic wavefront shape and directionality of this acoustic wavefront. These calculated parameters for the plane array speaker can then be deployed via the selected communication method, such as a wireless Ethernet connection.

Through using the above method to establish a dual mode of operation of the plane array speaker system, two or more audio inputs can then be routed through each separate processing chain so as to produce two or more acoustic wavefronts from the plane array speaker, each wavefront being overlayed in space, yet produced by the single plane array speaker. In the example listed above, two acoustic wavefronts of 40 degrees×40 degrees are produced by the same speaker, each separated by an angle of 40 degrees in the vertical (one beam of sound being −20 degrees in the horizontal, and the other beam of sound being +20 degrees in the horizontal)

It will be appreciated that the step of determining the optimum operating parameters for the plane array speaker may be simplified by presenting the operator with a preset of parameters for the plane array speaker. The preferred preset would be the parameters example listed above, providing two 40×40 degree acoustic wavefronts with 40 degree separation, angled vertically +45 degrees, although any preset configuration is possible. The use of preset predefined parameters for the plane array dual monitor mode will aid with ease of use.

Live Performer Tracking

In another embodiment of the present invention, the plane array speakers may also be employed to track the position of a performer on a stage or within an acoustic space to ensure that the sound can be directed to the performer at all times regardless of their position within the space. The position of the performer can be matched against known placement and position of multiple speaker systems that cover the space. Such a system can compensate for the distance the performer is from the speaker, and compensate for distance losses of the acoustic wavefront. Furthermore this method of operation can be used to reduce the possibility of feedback as open microphone sources track closer to the origin of the acoustic wavefront. Such a mode of operation of the present invention is referred to as a Live Performer tracking mode.

In a first step of operating the system in a Live Performer Tracking mode, a 3-Dimensional map of the space is firstly obtained in the manner as previously described in the earlier modes of operation referred to above.

Once a 3-Dimensional map has been created for the space, minimum of 3 antennae are set up around the perimeter of a stage or performer space can be fed into a computer, capturing signal strength. An RF transmitter is then attached to the moving performer that is transmitting a set frequency or spread of frequencies. A basic single frequency RF transmitter may be utilized, however an RFID transmitter in the form of an IEEE802.15.4-2011 UWB compliant wireless transceiver is preferred, such as the DecaWave's DW1000 IC. The received signals from the 3 or more receiving antennae are then received by a computer system and via a conventional triangulation algorithm, that considers the signal strength and timing information of the signals, the position of the RF transmitter relative to the 3 (or more) receiving antennae can be determined with up to 10 cm or greater accuracy.

The location of the transmitter is then able to be mapped within the 3-Dimensional space by way of a conventional computer model. Within this computer model the location and orientation of the one or more plane array speaker systems is manually input.

During the performance, the position of the performer relative to one or more plane array loudspeakers is able to be continuously monitored. Through simple geometric algorithms, the geometric information of the direction of the performer from the plane array speaker is able to be calculated. Once the direction of the performer from one or more plane array speakers is known, the pan and tilt parameters can be automatically determined to allow for the performer's personal audio mix to be directed towards the performer. The horizontal and vertical dispersion of the wavefront can be pre-determined by the operator, however a dispersion of 40 degrees horizontal and 40 degrees vertical is preferred. The system can then make optimal selection of the values of a, b, the asymmetry for the Airy function, $\Delta$ and $\Lambda$ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. From this anaylsis the best parameters for each loudspeaker element to create the desired acoustic wavefront shape and directionality of this acoustic wavefront can be determined. Such parameters for each plane array speaker can then be deployed to the speaker via the selected communication method, preferably via a wireless Ethernet.

In a variation of this method, the distance between the performer and plane array speaker can be calculated based upon the known position of the performer and the known position of the plane array speaker. A simple algorithm can then be applied that affects the overall gain of the plane array speaker. In this manner, the level of the audio being directed at the performer can automatically be adjusted, allowing for an increase in level the further away the performer is, and a reduction of the level the closer the performer is to the plane array speaker, relative to a predetermined level determined by the performer and operator. In this manner the level of audio heard by the performer remains constant, and the effects of feedback due to a microphone with too high gain in close proximity to the plane array speaker can be automatically negated.

It will be appreciated that the steps of the Live Performer Tracking Mode described above can be continually repeated to provide for continuous updating and refreshing the direction and amplitude of the performers audio mix. The preferred refresh rate is one update per second of time, however other update times are possible.

3-Dimensional Plane Array Sound Bar

In accordance with another embodiment of the present invention, the speaker system may be configured to produce one or more acoustic wavefronts at the same time. By using more than one sound source, and applying different discrete processing for each sound source prior, the custom acoustic wavefronts can be summed and produced by a single speaker system in accordance with this invention. Summation can occur pre or post amplification stage. As an example only, a surround sound cinematic mix can be directed towards a listener in a room, with different sounds being directed off ceilings, floors and walls with the purpose of being reflected off these surfaces to the listener to provide acoustic directionality, through said single speaker system.

Current surround sound bar systems only provide sound enveloping on a single horizontal axis only. Furthermore, current surround sound bar technology can only provide direction via linear delay (i) and focus (ii). When a listener is not central within the space the increase in amplitude of the closest audio source shifts the audio image for the listener towards the louder acoustic source. Simple gain adjustments can correct this amplitude balance between surround sound sources, however the correction comes at the cost of shifting the focus for other listeners within the surround sound field. As such, current surround sound systems can only optimize a single listener location.

A more immersive surround sound field can be produced by enveloping the listener by adding vertically controlled sound. As an example only, a domestic 3-Dimensional sound bar for cinema and gaming use may produce 13 discrete audio channels:

Front Left, Front center, Front Right

Mid Left, Mid Right, Surround Left, Surround Right

Above Left, Above Centre, Above Right

Below Left, Below Centre, Below Right

Furthermore, by combing the asymmetry and skew of the Airy function, a sound field can be produced that compensates and normalizes acoustic gain between different listener locations within a space for any and all audio sources, thereby preserving the acoustic focus for all listeners within the surround field environment. In doing so, the "sweet spot" of the optimal seating location for preserving spatial imaging is broadened to the entire audience space. A speaker system in accordance with this invention may optimize the surround sound field for all listeners simultaneously.

Method

1) Cinematic and gaming media may be encoded with a number of discrete audio channels that are decoded. The number of audio channels decoded is transposed to correlate to the number of channels available in 3-Dimensional sound bar. The preferred number of channels is 13 channels, however other channel counts are possible.

2) Each specific implementation of the 3-Dimensional plane array sound bar is pre-programmed with different discrete processing for each sound source. The preferred implementation sees the following acoustic wave front dispersion characteristics:
   - Front Left—Left hand one third of transducers of sound bar used only. Dispersion beam of 20×20 degrees, angled −10 degrees horizontal, 0 degrees vertical.
   - Front center—All transducers of sound bar used. Dispersion beam of 20×20 degrees, angled 0 degrees horizontal, 0 degrees vertical.
   - Front Right—Right hand one third of transducers of sound bar used only. Dispersion beam of 30×30 degrees, angled +10 degrees horizontal, 0 degrees vertical.
   - Mid Left—All transducers of sound bar used. Dispersion beam of 20×20 degrees, angled −45 degrees horizontal, 0 degrees vertical.
   - Mid Right—All transducers of sound bar used. Dispersion beam of 20×20 degrees, angled +45 degrees horizontal, 0 degrees vertical.
   - Surround Left—All transducers of sound bar used. Dispersion beam of 20×20 degrees, angled −15 degrees horizontal, 0 degrees vertical.
   - Surround Right—All transducers of sound bar used. Dispersion beam of 20×20 degrees, angled +15 degrees horizontal, 0 degrees vertical.
   - Above Left—All transducers of sound bar used. Dispersion beam of 20×20 degrees, angled −45 degrees horizontal, +45 degrees vertical.
   - Above Centre—All transducers of sound bar used. Dispersion beam of 20×20 degrees, angled 0 degrees horizontal, +45 degrees vertical.
   - Above Right—All transducers of sound bar used. Dispersion beam of 20×20 degrees, angled +45 degrees horizontal, +45 degrees vertical.
   - Below Left—All transducers of sound bar used. Dispersion beam of 20×20 degrees, angled −45 degrees horizontal, −45 degrees vertical.
   - Below Centre—All transducers of sound bar used. Dispersion beam of 20×20 degrees, angled −0 degrees horizontal, −45 degrees vertical.
   - Below Right—All transducers of sound bar used. Dispersion beam of 20×20 degrees, angled +45 degrees horizontal, −45 degrees vertical.

3) Each decoded audio signal is feed through its discrete processing channel, creating the 3-Dimensional immersive sound field.

To employ such a system, a user may enter the dimensions of their room, seating location and 3-Dimensional sound bar model into a computer interface. Once the environmental conditions are known, the software can then make optimal selection of the values of a, b, the asymmetry for the Airy function, Δ and Λ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. The calculated parameters for the plane array speaker can then be deployed via the selected communication method, preferably via a wireless Ethernet connection.

3-Dimensional Plane Array Cinema

It will be appreciated that the present invention also provides an application in a cinema situation to create a 3-Dimensional Plane Array Cinema Such an embodiment of the present invention may or may not utilize the present speaker system's ability to produce one or more acoustic wavefronts at the same time. By using more than one sound sources, and applying different discrete processing for each sound source prior, the custom acoustic wavefronts can be summed and produced by a single speaker system. In such an embodiment of the present invention, a large format plane array speaker system can be constructed behind an acoustically transparent projection screen. A sound can be generated with an acoustic focus at any location on the screen by restricting the number of elements within the plane array system that is being utilized to produce the audio signal. This sound source can then be projected at all listeners within the cinema audience plane. As such, the acoustic and visual focus is perfectly aligned.

Furthermore, the custom acoustic wavefront configuration can be calculated so that the acoustic source perfectly covers the entire audience plane, and can compensate for distance losses, providing an evenness of coverage with respect to sound pressure levels. By combing the asymmetry and skew of the Airy function, a sound field can be produced that compensates and normalizes acoustic gain between different listener locations within a space for any and all audio sources, thereby preserving the acoustic focus for all listeners within the surround field environment. In doing so, the "sweet spot" of the optimal seating location for preserving spatial imaging is broadened to the entire audience space. A speaker system in accordance with this invention may optimize the surround sound field for all listeners simultaneously.

Method

1) Cinematic media may be encoded with a number of discrete audio channels. Each audio channel is also encoded with the X-Y-Z co-ordinates relating to the acoustic focus within 3-dimensional space within the room.
2) The cinema has a known environment and source information, which details the size, geometric shape and dimensions of the cinema space, as well as the size and location of the plane array speaker system, loudspeaker spacings, and transducer sizes and spacing.

Custom computer algorithms receive encoded information of the location of acoustic focus. The software can then make optimal selection of the values of a, b, the asymmetry for the Airy function, Δ and Λ by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. From this anaylsis the software can then determine the best parameters for each source element to create the desired acoustic focus, acoustic wavefront shape and acoustic directionality for each acoustic source, that is optimized for the audience size and shape. The software calculated parameters for the plane array speaker can then be deployed via the selected communication method. The preferred communication method is wireless Ethernet.
3) The computer algorithm is preferably always be updating and computing ideal acoustic parameters based upon the encoded instructions accompanying the encoded audio stream. As such the software can support movement of sources whilst preserving acoustic focus for all audience members.

Design and Modelling Software

A software suite in accordance with this invention can be used to aid in the tasks of modelling sund distributions and customising the wavefronts to match a desired operating environment. The software preferably will make use of hardware acceleration where available in order to parallelise the processing where loops over several variables need to be taken.

The software may comprise the following components:

1) GUI Front End: An interface (whether desktop, web based or otherwise) that allows for functionality such as setting speaker array and environmental parameters (through e.g. tabular entry of data or an interactive graphical control) or manually setting the magnitude and delay of the speakers, viewing the resultant wavefront and the frequency response, and exporting results and configuration for the speaker array. A typical run sequence of the Front End is (i) Load speaker data (parameters defining a cluster of speakers e.g. number and offset spacing between boxes and for each frequency band the frequency range, SPL, speaker size, spacing and number) (ii) Load environmental data (parameters calculated from a laser scan of the environment, e.g. distance to the audience and for each beam the horizontal & vertical pan/tilt spread, skew and top,bottom,left,right slopes of a rough enclosing quadrilateral), (iii) Compile runtime kernels (e.g. for design, 3d modelling at single frequencies and a broadband average, frequency response) (iv) Setup GUI (e.g. using an event based framework such as GTK or Qt).
2) Design backend: The design backend will take as arguments a set of environmental parameters and a few parameters defining the speaker array, from which it produces an array of delay values for each speaker in the array. An example of such environmental parameters are angular offsets (eg pan/tilt),
3) spread and skew for each dimension on the wavefront, and for each pair of dimensions a set of 4 slopes defining an enclosing quadrilateral (eg top,
4) bottom, left, and right slopes). Speaker parameters may e.g. include speaker count and spacing for each dimension of the speaker array and for clusters of speakers their respective number and and spacing for each cluster dimension. The algorithm will use equations (1), (3) and (4) to calculate the phase distribution across the speaker array and from that calculate the delay values for each speaker.
5) Modelling Backend: The modelling backend is a wrapper for kernels where hardware acceleration is available or failing that runs the algorithms in a non-parallelised fashion. For modelling the spatial wavefront (whether 2d or 3d) the calculation method is that for each band and channel iteration is made over the wavefront dimensions to calculate the magnitude and phase as a sum of contributions from each speaker (and frequency if a broadband result is desired) (preferably using kernel to parallelise over a set of dimension variables and exploit symmetries where they exists). Wave propagation is calculated using the Fresnel diffraction equations. For modelling the frequency response a similar method is taken as the 3d broadband model, except that a coarser spatial resolution and a finer frequency resolution is used for the model. From the frequency response EQ filter values are calculated that will flatten the frequency response.

The Formula for Fresnel diffraction used by the modelling software is given by:

$$E(w_1, w_2, z) = \frac{z}{i\lambda}\int\int E(s_1 s_2)\frac{e^{ikr}}{r^2}\,ds_1\,ds_2 \tag{8}$$

where E is the (sound) field, $\lambda=2\pi/k$ is the wavelength, $w_{1,2}$ are wavefront dimensions, $s_{1,2}$ are the dimensions across the speaker array, z is the normal to them and $r=((w_1-s_1)^2+(w_2-s_2)^2+z^2)^{1/2}$ is the radius from the speaker source to the point under consideration.

It will be appreciated by a person skilled in the art that numerous variations and/or modifications may be made to the present invention as shown in the specific embodiments without departing from the spirit of scope of the invention as broadly described. The present embodiments are therefore to be considered in all respects to be illustrative and not restrictive. For example the shape and configuration of the speaker housing, the number and size of the arrays/segments/band limited layers/acoustic sources/drivers and the methods of mounting the HF and LF segments may change according to application and design preference. Further, optimal selection of the values of $\Delta$ and $\Lambda$ can be achieved by (i) only making calculations at the peaks and troughs of the spatial distribution, (ii) using a regression fit over more data points, (iii) using Fourier analysis to identify periodicities and amplitudes in the spatial distribution, or (iv) using Genetic Algorithms/Simulated annealing, etc. Furthermore, while the preferred embodiments have been described for the purpose of simplicity in the context of 1-dimensional targets and speaker arrays, the present invention extends to multi-dimensional targets and multi-dimensional speaker arrays.

What is claimed is:

1. A speaker system for providing customised acoustical wavefronts with vertical and horizontal pattern control and amplitude and phase control, said system including a speaker housing having therein at least a first two-dimensional array of high frequency driver segments and a secondary array of low frequency driver segments disposed behind said first two-dimensional array, said first two-dimensional array having sufficient space between said driver segments to allow acoustic transparency whereby a wavefront from said secondary array can reasonably pass through said first two-dimensional array.

2. The speaker system as claimed in claim 1 wherein said space between said driver segments is at least 10% of the total area of said first two-dimensional array.

3. The speaker system as claimed in claim 1 wherein when in use each segment is associated with a respective acoustic source which provides a processed and amplified signal to create an amplitude and phase controlled horizontal and vertical sound pattern.

4. The speaker system as claimed in claim 1 wherein the distance between outer edges of an acoustic source radiating surface of one driver element and outer edges of an acoustic source radiating surface of an adjacent driver segment in said first two-dimensional array and said secondary array is no greater than ten wavelengths in distance of the highest frequency controlled by said one driver segment and said adjacent driver segment.

5. The speaker system as claimed in claim 3 wherein said segment size is less than ten wavelengths in size of the highest frequency controlled by said one driver segment.

6. The speaker system as claimed in claim 1 wherein said speaker system is adapted to produce a range of frequencies which are divided into one or more frequency bands through the use of band limiting filters.

7. The speaker system as claimed claim 6 in combination with a laser rangefinder and computer system whereby a local area around said speaker system is scanned to create a 3-dimensional model thereof to aid selection of speaker setup and operating parameters.

8. The speaker system as claimed in claim 6 in combination with camera and computer systems with facial recognition software for observing and analysing occupancy and audience boundary conditions to aid speaker setup and operating parameters.

9. The speaker system as claimed in claim 6 in combination with software for providing two or more multi-dimensional wavefronts simultaneously for the purpose of directing sound towards two or more performers in two or more physically separate locations at the same time from the same speaker system.

10. The speaker system as claimed in claim 6 in combination with an RFID transmitter and receiving antennas for tracking a location and movement of a performer across a stage or acoustic space for the purposes of optimizing the acoustic wavefront generated by the speaker system so as to direct the sound specifically to the performer in terms of acoustic wavefront direction.

11. The speaker system as claimed in claim 6 in combination with an RFID transmitter and receiving antennas for tracking a location and movement of a performer across a stage or acoustic space for the purposes of optimizing the acoustic wavefront generated by the speaker system, so as to direct the sound specifically to the performer in terms of acoustic wavefront shape.

12. The speaker system as claimed in claim 6 in combination with an RFID transmitter and receiving antennas for tracking a location and movement of a performer across a stage or acoustic space for the purposes of optimizing the acoustic wavefront generated by the speaker system, so as to direct the sound specifically to the performer in terms of acoustic wavefront amplitude.

13. The speaker system as claimed in claim 6 for use as a 3-dimensional sound bar for providing discrete audio signals for cinematic or gaming media with vertical controlled acoustic wavefronts.

14. The speaker system according to claim 13, comprising an array of 2 or more loudspeakers in combination for use as a 3-dimensional sound bar to create normalize sound pressure levels of various acoustic sources at any location across a wide audience area to optimize the stereo or surround sound field for a broad number of listeners simultaneously.

15. The speaker system according to claim 14 for use as a 3-dimensional sound bar with the ability to normalize sound pressure levels of various acoustic sources at any location across a wide audience area to optimize the stereo or surround sound field for a broad number of listeners simultaneously.

16. The speaker system as claimed in claim 6 for use in cinema to produce a multi dimensional sound field in the vertical and horizontal planes from any said speaker system.

17. The speaker system as claimed in claim 6 for use in cinema to create an acoustic focus that originates from the same location as a visual source on screen.

18. The speaker system as claimed in claim 15 for use in cinema to create an acoustic focus from any nominal location whilst providing the ability to cover all listeners within the audience plane.

19. The speaker system as claimed in claim 14, configured to normalize sound pressure levels (of various acoustic sources at any location) across a wide audience area to optimize the stereo or surround sound field for a broad number of listeners simultaneously.

20. The speaker system as claimed in claim 14, comprising one or more loudspeakers to normalize sound pressure levels (of various acoustic sources at any location) across a wide audience area to optimize the stereo or surround sound field for a broad number of listeners simultaneously.

* * * * *